US007044522B2

(12) United States Patent
Serpas et al.

(10) Patent No.: US 7,044,522 B2
(45) Date of Patent: May 16, 2006

(54) PASSIVE CAPTURE SLIP-PROOF CHAIN HANDLING HOOK

(75) Inventors: Raymond J. Serpas, New Orleans, LA (US); Kirk N. Trombatore, Mandeville, LA (US); Regas J. Vito, Houma, LA (US)

(73) Assignee: J. Ray McDermott, S.A., Houston, TX (US)

( * ) Notice: Subject to any disclaimer, the term of this patent is extended or adjusted under 35 U.S.C. 154(b) by 0 days.

(21) Appl. No.: 10/263,882

(22) Filed: Oct. 3, 2002

(65) Prior Publication Data

US 2004/0066051 A1 Apr. 8, 2004

(51) Int. Cl.
*B66C 1/34* (2006.01)

(52) U.S. Cl. ..... 294/82.1; 294/82.24

(58) Field of Classification Search ..... 294/82.1, 294/82.24, 82.31, 66.1, 82.11, 82.14, 82.12, 294/82.17; 59/93; 24/116 R
See application file for complete search history.

(56) References Cited

U.S. PATENT DOCUMENTS 273,310 A * 3/1883 Rairigh ..... 294/82.32
951,463 A * 3/1910 Spears ..... 294/82.1
1,339,986 A * 5/1920 Schmidt ..... 24/600.9
1,531,770 A * 3/1925 Walker ..... 24/116 R
2,090,897 A * 8/1937 Ray et al. ..... 24/116 R
2,630,610 A * 3/1953 Lock ..... 24/116 R
4,416,319 A * 11/1983 Hofmann ..... 152/213 R
4,515,198 A * 5/1985 Labonville ..... 152/223
4,693,097 A * 9/1987 Rivera ..... 70/18

* cited by examiner

*Primary Examiner*—Dean J. Kramer
(74) *Attorney, Agent, or Firm*—D. Neil LaHaye; Eric Marich

(57) ABSTRACT

A chain hook with no moving parts that is capable of passively capturing and supporting both sides of a given chain link. The hook is provided with dual support surfaces that support the link and prevent disengagement of the hook while under load. A horn between the support surfaces protrudes through the hooked link and contacts the adjacent link on the lighter loaded side of the hook. This prevents running of the chain that could result from differential loading on either side of the hooked chain link. The hook surfaces are designed to inhibit disengagement under low load conditions and to facilitate unassisted disengagement of the hook under no-load conditions.

1 Claim, 2 Drawing Sheets

PASSIVE CAPTURE SLIP-PROOF CHAIN HANDLING HOOK

BACKGROUND OF THE INVENTION

1. Field of the Invention

The invention is generally related to equipment used in the offshore drilling and production industry to handle chains, and more particularly to hooks used to capture large chain links.

2. General Background

In the offshore industry of drilling for and producing hydrocarbons, a combination of anchors fixed in place in the sea floor, chains, and various types of ropes including wire ropes are used to moor floating platforms, mooring buoys, and vessels in place. Due to the water depths, environmental forces, and size of the floating platforms and vessels the size of the wire, ropes, and chains tends to be very large. As an example, it is not uncommon for the wire, ropes, and chain material to have a diameter of five to six inches. Such large materials require special equipment when performing installation, maintenance, or repair work.

Handling of chains can be accomplished using hooks. The hook typically encompasses the outside of an individual link at one end where it joins with an another link and uses the weight and associated bearing of the adjacent chain links to keep the link in place on the hook. All of the various types of commercially available chain handling hooks follow this general principle. Examples of handling devices are the grab hooks, Devil's Claw, Pelican Hook, and a hook made by British Engines Ltd (to be referred to as a BEL hook).

A grab hook is a conventional hook with the opening narrowed down to capture a given chain link. These hooks only support one side of the captured link.

The Devil's Claw chain stopper straddles either side of a loaded link capturing both sides of the next (load bearing) link. It is not intended to support a span of chain through lateral support of a given link.

The Pelican Hook is designed to capture and support a given chain link in the mid-span of the chain. The pelican hook only bears on one side of the captured link and is secured with a bail to prevent opening and secure the link.

The BEL hook is also designed to capture and support a given chain link in the mid-span of the chain. It also bears only on one side of the captured chain link and can be prone to "chain running" if there is sufficient difference between the load in the chain on either side of the hook.

The known art is lacking in that it supports only one side of the captured link, does not support a span of chain through lateral support of a given link, is only designed to support a given chain link in the mid-span of the chain and requires a moving part such as a bail, or can be prone to chain running.

SUMMARY OF THE INVENTION

The invention addresses the shortcomings of the known chain hooks. What is provided is a chain hook with no moving parts that includes a means of passively capturing and supporting both sides of a given chain link. The hook is provided with dual support surfaces that support the link and prevent disengagement of the hook while under load. A horn between the support surfaces protrudes through the hooked link and contacts the adjacent link on the lighter loaded side of the hook. This prevents running of the chain that could result from differential loading on either side of the hooked chain link. The hook surfaces are designed to inhibit disengagement under low load conditions and to facilitate unassisted disengagement of the hook under no-load conditions.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figures 1, 2:
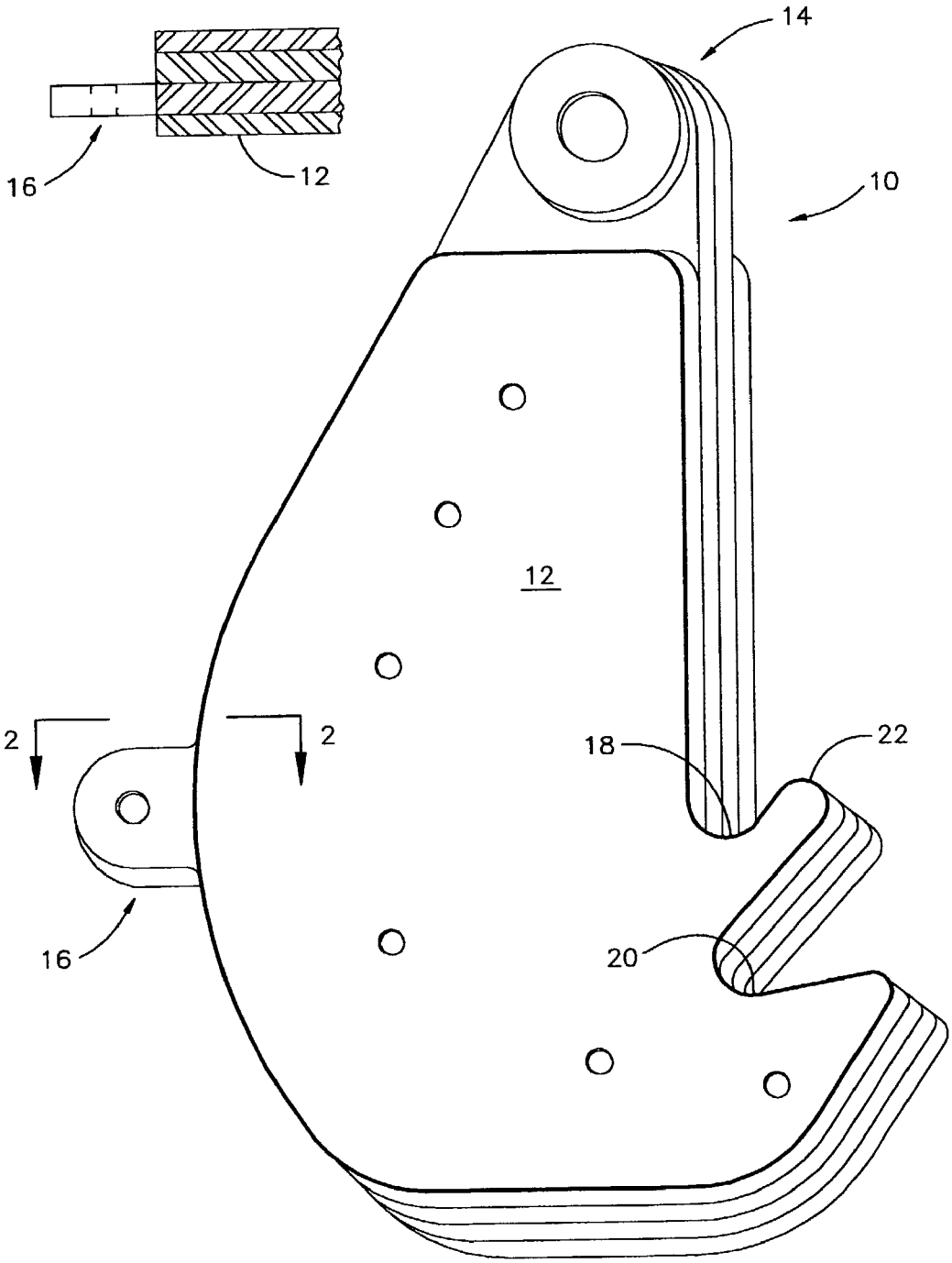
FIG. 1 is a perspective view of the invention.
FIG. 2 is a section view taken along lines 2—2 in FIG. 1.

Referring to FIG. 1, it is seen that the invention is generally indicated by the numeral 10. Chain hook 10 is generally comprised of a body 12 having two connection means 14, 16, chain link support surfaces 18, 20, and a horn 22.

The first connection means 14, illustrated as an eyehole, is located at the top of the body 12 and is sized to allow attachment of a shackle not shown. This allows attachment to a lifting/handling machine (e.g. a derrick crane or any other handling machine) by means of a sling or chain. This eyehole may be replaced with another connection configuration such as a trunnion, a clevis, an eyehole for another hook, or any other connection means compatible with the intended use of the hook.

The second connection means 16, illustrated as an eyehole, is located at the back of the body 12 and at a level near the first chain link support surface and is sized to allow attachment of a shackle not shown. This allows attachment to a sling or chain to help orient the chain hook 10 during operations to engage or disengage the hook with a chain link, as well as during general handling of the hook. This eyehole may be replaced with another connection configuration such as a simple handle, an eyehole for another hook, a hook, or other connection means compatible with the chain hook 10.

The chain link support surfaces 18, 20 are spaced apart according to the size of the links on the chain to be moved. The spacing and alignment of the support surfaces 18, 20 is designed such that both sides of a hooked chain link are supported. The first or upper chain link support surface 18 is formed by horn 22. The second or lower chain link support surface 20 extends out from the front of the body 12. It can be seen that the chain link support surfaces 18, 20 are vertically spaced apart and separated from each other by the horn 22.

The horn 22 protrudes out from the front of the body 12 and upward. It is seen that the horn 22 defines the first or upper chain link support surface 18. The horn 22 is contoured to easily slip into a chain link and to inhibit disengagement under low load conditions. The bottom of the horn 22 is sloped at an angle toward the bottom of the body 12. This facilitates unassisted disengagement of the chain hook 10 under no load conditions.

FIG. 2 illustrates the use of multiple parts to build up the body 12 and in particular shows the back connection means or eyehole 16.

The chain hook 10 is illustrated as being built up of multiple parts or plates. However, it should be understood that the chain hook may be manufactured either as a single unit by cutting, stamping, forging or casting from a single unit of material, or built up from multiple parts. A main criteria of construction is that the material and construction method provide sufficient strength for the intended application.

Figure 3:
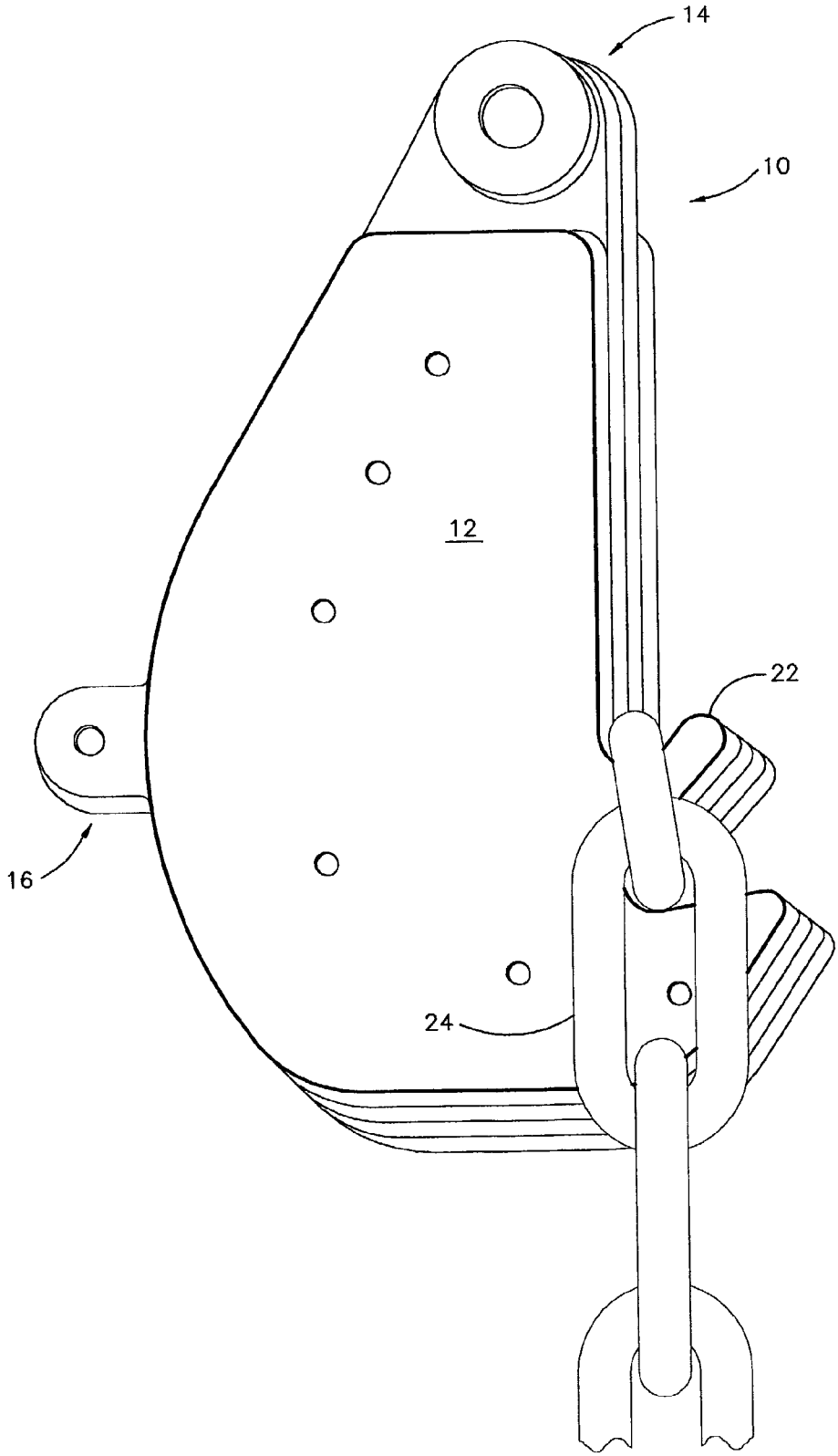
FIG. 3 illustrates the invention engaged with a chain.

In operation, the connection means 14, 16 are connected to a lifting and moving mechanism. The chain hook 10 is then maneuvered into position adjacent a chain to be moved. The chain hook 10 is moved to cause the horn 22 to be inserted into a selected chain link. Once the horn 22 is fully inserted into the selected chain link, the chain hook 10 is lifted to place a load from the chain onto the chain hook 10 as illustrated in FIG. 3. When under load, the horn 22 contacts the adjacent chain link 24 on the lighter loaded side of the hook, which prevents running of the chain that is normally caused by differential loading on either side of the hooked chain link. Due to the horn protruding through a chain link, and the presence of the dual support surfaces 18, 20, the chain is fully captured without the need for any moving parts such as a bail. The chain is lifted and the necessary work on the chain or associated equipment is performed.

When replacing the chain, the chain hook 10 and the horn 22 are readily disengaged by lowering the chain with the chain hook 10 until there is no load on the chain hook 10. The connection means 16 is used to move the chain hook 10 backwards away from the chain. During this movement the horn 22 is disengaged from the chain link.

The invention provides several advantages. The chain hook is able to fully capture a chain and prevent slippage of the hooked link without the need for any moving parts. The dual support surfaces contact both sides of the chain link. This enables the handling of higher loads because the chain link cannot open or close up as could occur if only one side of the chain link was supported. The insertion of the horn into a chain link prevents unintentional disengagement of the chain hook from the chain. The capture of the chain link prevents the chain from disengaging from the chain hook, as could happen with a conventional hook due to unequal loading caused by the differential weight of the suspended chain, or to a load supported by the chain. The invention provides greater simplicity because it passively captures the chain link without the need for moving part capture mechanisms.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

The invention claimed is:

1. A chain hook for passively capturing and supporting both sides of a given chain link to handle a continuous length of chain, comprising:

a. a body;

b. a first connection means provided at the top of said body;

c. a second connection means provided at the back of said body, said second connection means being used to handle the chain hook and during engagement or disengagement of a chain link but not during load bearing operations;

d. a horn projecting outward from the front of said body and sized to be received in one chain link, said horn protruding through the engaged link and contacting the adjacent link on the lighter loaded leg of a continuous chain thereby providing a means of support for any unequal loading in the leg of a continuous chain;

e. a first chain link support surface on the front of said body defined by said horn;

f. a second chain link support surface on the front of said body and positioned below said horn; and g. said first and second chain link support surfaces providing support to both sides of an engaged chain link in the near vertical position when the chain link is placed under loading support by the chain hook, said first and second chain link support surfaces allowing release of the engaged chain link upon removal of the supporting load.

* * * * *